US011371689B2

(12) United States Patent
Rössler

(10) Patent No.: US 11,371,689 B2
(45) Date of Patent: Jun. 28, 2022

(54) EXPLOSION-PROOF LUMINAIRE

(71) Applicant: R. STAHL SCHALTGERÄTE GMBH, Waldenburg (DE)

(72) Inventor: Klaus Rössler, Niedernhall (DE)

(73) Assignee: R. STAHL SCHALTGERÄTE GMBH, Waldenburg (DE)

( * ) Notice: Subject to any disclaimer, the term of this patent is extended or adjusted under 35 U.S.C. 154(b) by 46 days.

(21) Appl. No.: 16/618,220

(22) PCT Filed: May 18, 2018

(86) PCT No.: PCT/EP2018/063150
§ 371 (c)(1),
(2) Date: Nov. 29, 2019

(87) PCT Pub. No.: WO2018/219695
PCT Pub. Date: Dec. 6, 2018

(65) Prior Publication Data

US 2020/0116343 A1 Apr. 16, 2020

(30) Foreign Application Priority Data

Jun. 1, 2017 (DE) ..... 10 2017 112 146.3

(51) Int. Cl.
*F21V 25/12* (2006.01)
*F21V 31/00* (2006.01)
(Continued)

(52) U.S. Cl.
CPC ..... *F21V 25/12* (2013.01); *F21V 31/005* (2013.01); *F21V 17/12* (2013.01); *F21V 19/001* (2013.01); *F21V 31/04* (2013.01); *F21Y 2115/10* (2016.08)

(58) Field of Classification Search
CPC ..... F21V 25/12; F21V 31/005; F21V 17/12; F21V 19/001; F21V 31/04; F21Y 2115/10
See application file for complete search history.

(56) References Cited

U.S. PATENT DOCUMENTS

2016/0084483 A1 3/2016 Dubuc et al.

FOREIGN PATENT DOCUMENTS

DE 3617570 A1 11/1987
DE 3634556 A1 4/1988
(Continued)

OTHER PUBLICATIONS

Written Opinion for Application No. 11201911175V.
(Continued)

*Primary Examiner* — Mary Ellen Bowman
(74) *Attorney, Agent, or Firm* — Cantor Colburn LLP

(57) ABSTRACT

The luminaire according to the invention comprises an inner space that is separated into a first section and a second section by a separating wall. While the first section is free and comprises at least one light source, an operating circuit for the light source and/or other components that form potential ignition sources and/or other components that may not be considered as ignition sources are arranged in the second section. The second section is provided with an open pored fill material. The separating wall comprises at least one opening that allows a flow connection between the two sections. The section of the inner space provided with fill material serves as pressure relief volume for the first section, in which the light source is arranged. The fill material can fill the section completely or partly.

17 Claims, 2 Drawing Sheets

(51) Int. Cl.

| | |
|---|---|
| ***F21Y 115/10*** | (2016.01) |
| ***F21V 17/12*** | (2006.01) |
| ***F21V 19/00*** | (2006.01) |
| ***F21V 31/04*** | (2006.01) |

(56) References Cited

FOREIGN PATENT DOCUMENTS

| | | | | |
|---|---|---|---|---|
| EP | 1156272 | A2 | * | 11/2001 |
| EP | 1156272 | A2 | | 11/2001 |
| EP | 2998648 | A1 | * | 9/2015 |
| EP | 2998648 | A1 | | 3/2016 |
| WO | 2012105828 | A1 | | 8/2012 |
| WO | WO-2012105828 | A1 | * | 8/2012 |

OTHER PUBLICATIONS

English Machine Translation of Abstract EP1156272.
English Machine Translation to Abstract EP2998648.
International Search Report for Application No. PCT/EP2018/063150.
English Machine Translation to Abstract of corresponding document: EP0264039 (correponds with DE3634556).
English Machine Translation to Abstract DE3617570.
Written Opinion for Application No. PCT/EP2018/063150.

* cited by examiner

EXPLOSION-PROOF LUMINAIRE

CROSS-REFERENCE TO RELATED APPLICATIONS

This application is a national phase application under 35 U.S.C. § 371 of International Patent Application No. PCT/EP2018/063150 filed on May 18, 2018, which claims priority to German Patent Application No. 10 2017 112 146.3 filed on Jun. 1, 2017, the contents each of which are incorporated herein by reference thereto.

TECHNICAL FIELD

Subject matter of the invention is an explosion-protected LED-luminaire.

BACKGROUND

From DE 36 34 556 A1 an explosion-protected and flameproof luminaire enclosure and a transparent cover part attached thereto is known. The luminaire enclosure contains electric components for operating a lamp that is arranged below a cover part. The cover part is also enclosed in a flameproof manner, such that the flameproof enclosure as a whole surrounds two separately enclosed inner spaces. In the luminaire enclosure filler parts with large volume are inserted, wherein the free remaining space between the filler parts and the electronic components present within the enclosure is limited to less than 3 liters. The filler parts consist, for example of foamed plastic. Additionally sand, silica dust or glass balls can be used as filler parts. A filling of the enclosure with liquid that may have a cooling effect for the electric components is also proposed. Filler parts that can, for example, serve as reflector carriers can also be present in the cover part. The enclosure as well as the transparent cover part can be manufactured from plastic.

In the field of explosion protection the filling of an enclosure with pourable material is also known as protection by powder filling. For example, DE OS 36 175 70 describes the arrangement of circuit boards in an enclosure that is roundly closable and the filling thereof with electrically isolating sand or with glass spheres.

By introduction of pourable or other porous material in the enclosure, the volume of the explosive gas mixture present in the enclosure can be reduced. Additionally, the porous or pourable material can serve to reduce pressure peaks when igniting the gas mixture. However, this does not apply to the light-guiding part of a luminaire. Gas volume enclosed therein cannot be reduced by introduction of fill material, because this hinders the light exit or scatters light in an uncontrolled manner.

BRIEF SUMMARY

Starting therefrom it is the object of the invention to create an improved luminaire.

An explosion-protected luminaire, the explosion-protected luminaire having: an enclosure having a translucent section that surrounds an inner space; at least one separating wall having at least one opening, the at least one separating wall dividing the inner space of the enclosure into at least one first section without fill material and at least one second section with fill material; wherein the first section without fill material includes a light source and the first section is translucent in a region proximate to the light source; and wherein the second section is located behind the at least one separating wall, and the fill material is an open pored material.

The explosion-protected luminaire according to the invention comprises an enclosure with a separating wall comprising openings that divides the inner space of the enclosure in a first section and in a second section. While the first section contains at least one light source, preferably a semi-conductor light source, and is free of fill material, the second section is provided with open pored fill material. In doing so, an ignition starting from the semi-conductor light source may in fact lead to an explosion of the gas mixture present in the first section of the inner space, wherein however an excessive pressure build-up is avoided. Due to the openings in the separating wall, gas can escape in the second section of the inner space that is provided with open pored fill material and thus cannot build up high pressure.

In one embodiment the explosion-protected luminaire comprises an enclosure with a translucent section and surrounds an inner space. In the inner space a separating wall is arranged having at least one opening, the separating wall dividing the inner space of the enclosure in a first section and a second section. The first section adjoins the translucent section and comprises at least one light source. The second section of the inner space is provided with open pored fill material. Preferably a separating wall carries the light source and preferably an electronic operating circuit is embedded in the fill material.

The enclosure can be configured closed toward the outside. Indeed it is basically possible to provide the enclosure with pressure relief devices, like e.g. flame-protection filters that close the one or more openings connecting the environment with the inner space of the enclosure. It is, however, preferred that the enclosure is configured as being closed without such pressure relief devices effective toward the outside, such that problems with entering of humidity and dust collection or contamination are omitted.

Preferably the enclosure is configured of two enclosure parts between which the separating wall is held. This yields to a simple and clear configuration. With such a configuration it is particularly possible to forgo a gas tight sealing of the two sections of the inner space of the enclosure with regard to each other—it does not depend on such a sealing. On the contrary, the separating wall preferably comprises at least one and preferably a plurality of openings having a total cross-section of an amount, such that a free gas pass is possible. On the other hand, the fill material is preferably exclusively arranged in the second section of the inner space, but not in the first section thereof. At each opening of the separating wall a filter can be arranged that indeed allows the gas pass, however, blocks the transfer of fill material through the openings from the second section in the first section of the inner space. Such a filter can be an open pored textile material, for example in the form of one or more layers of a non-woven fabric, a thin felt, a woven fabric or a knitted fabric. Alternatively, a porous body can be used as filter that is arranged in the second section of the inner space loosely abutting at the separating wall or connected therewith. Neither the open pored textile material nor the open pored body must be fixedly connected with the separating wall. They can be arranged loosely abutting at the separating wall or can be attached thereto in sections. Additionally, neither the open pored textile material nor the open pored body must create a flame propagation protection. The function only consists in retaining the fill material. If the fill material is not pourable, because it is for example formed by a non-woven fabric, a batting type or another filamentary material, the mentioned filter can be avoided. Likewise such filters can be avoided, if the particles of a pourable fill material are larger than the diameter of the openings.

The second section of the inner space of the enclosure is preferably completely filled with fill material, such that no free gas volumes are present that could participate in an explosion. However, it can be sufficient that the second section of the inner space is only partly filled with fill material. Preferably the second section of the inner space is at least filled with fill material by more than half or further preferably by more than three quarters. A pourable fill material, like sand, glass spheres, ceramic spheres or the like can serve as such a fill material. Alternatively, glass wool, rock wool or other fiber materials can be used as fill material. If the second section of the inner space is partly filled with fill material, it can be attached at the inner wall of the enclosure.

The separating wall can be configured as circuit board that supports the LED-light source or a plurality of LED-light sources. Additionally, the separating wall can be configured from an electric isolating material, if it is configured as circuit board that supports conductor tracks. The circuit board can additionally support electronic components that can be arranged in the first section of the inner space of the enclosure, as well as in the second section of the inner space of the enclosure. Preferably the second section of the inner space of the enclosure accommodates an electronic circuit that can, for example, serve as operating device for the LED(s) of the first enclosure section. Preferably such an electronic circuit is arranged on an individual circuit board that is embedded in the fill material of the second section of the inner space. Further details of preferred embodiments of the invention arise from the drawings, the description or the claims.

DETAILED DESCRIPTION

Figure 1:
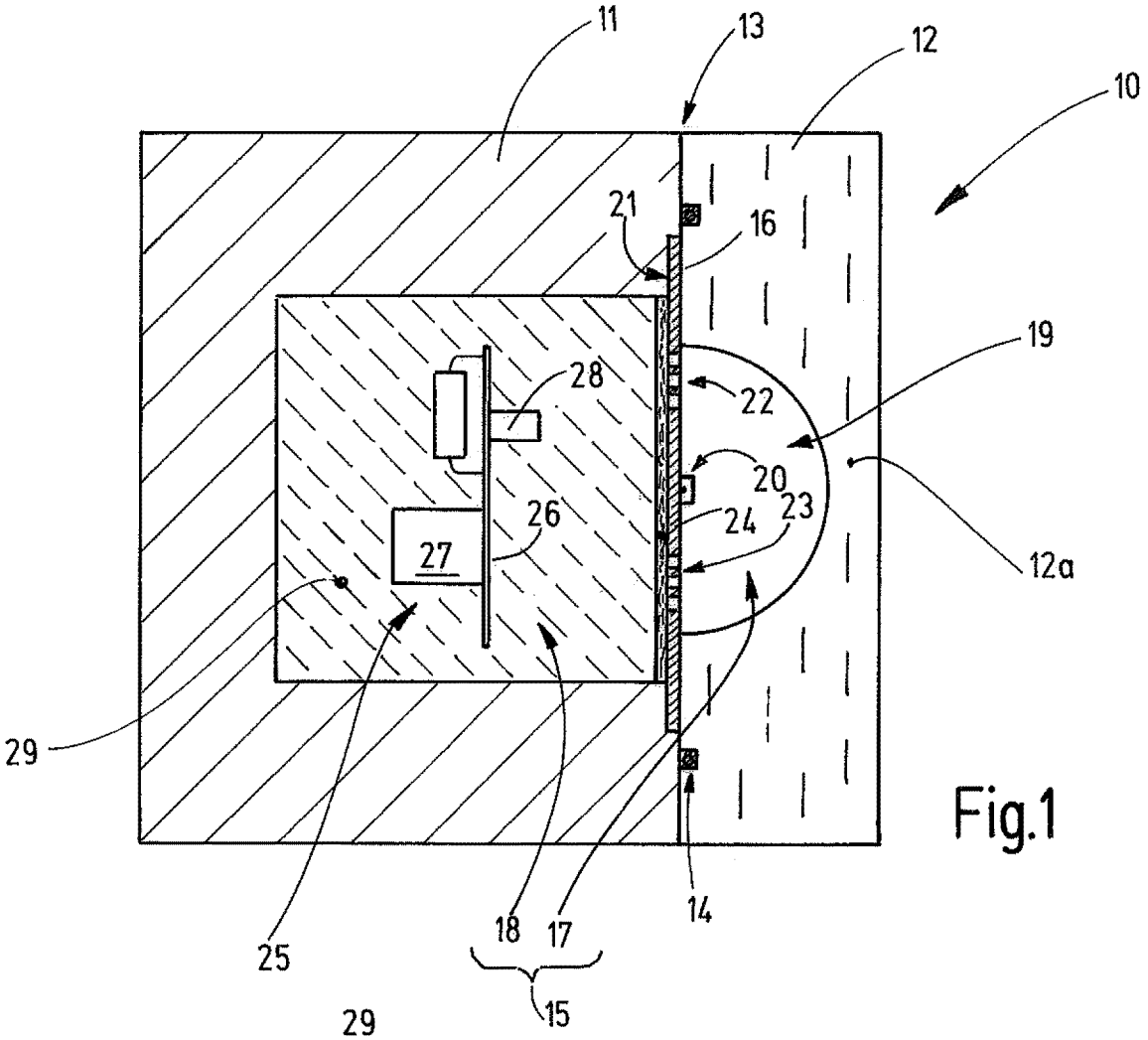
FIG. 1 the explosion-protected luminaire in a simplified cross-sectional illustration, FIG. 2 the luminaire of FIG. 1 in a schematic illustration, FIG. 3 a modified embodiment of a luminaire according to the invention.

FIG. 1 illustrates a luminaire 10 the enclosure of which consists preferably of at least two enclosure parts 11, 12 that are attached to each other by connection means that are not illustrated. Connection means can be screws, bolts, rivets, weld seams, glue seams, glue joints or the like. In the schematically illustrated embodiment in FIG. 1 the two enclosure parts 11, 12 abut against each other at a separating joint 13. The separating joint 13 can be configured in a planar or another shape, for example configured in the form of a thread or the like. As illustrated, it can be sealed by means of a seal 14, for example in the form of an O-ring or another profiled ring, a lip seal or the like, or can be configured due to its length and its width as flameproof gap. For example, the enclosure parts 11, 12 can be made of plastic, wherein the cover part 12 is preferably made of a transparent plastic or comprises at least a transparent window. The cover part 11 can also be made of plastic, for example a non-transparent plastic or also of metal or a metal/plastic compound.

The two enclosure parts 11, 12 surround an inner space 15 that is divided into a first section 17 and a second section 18 by a separating wall 16. The first section 17 of the inner space 15 adjoins the cover part 12 that is configured transparent or comprises a light exit window. A zone 12*a* of the enclosure part 12 can be considered as light exit window.

Figure 2:
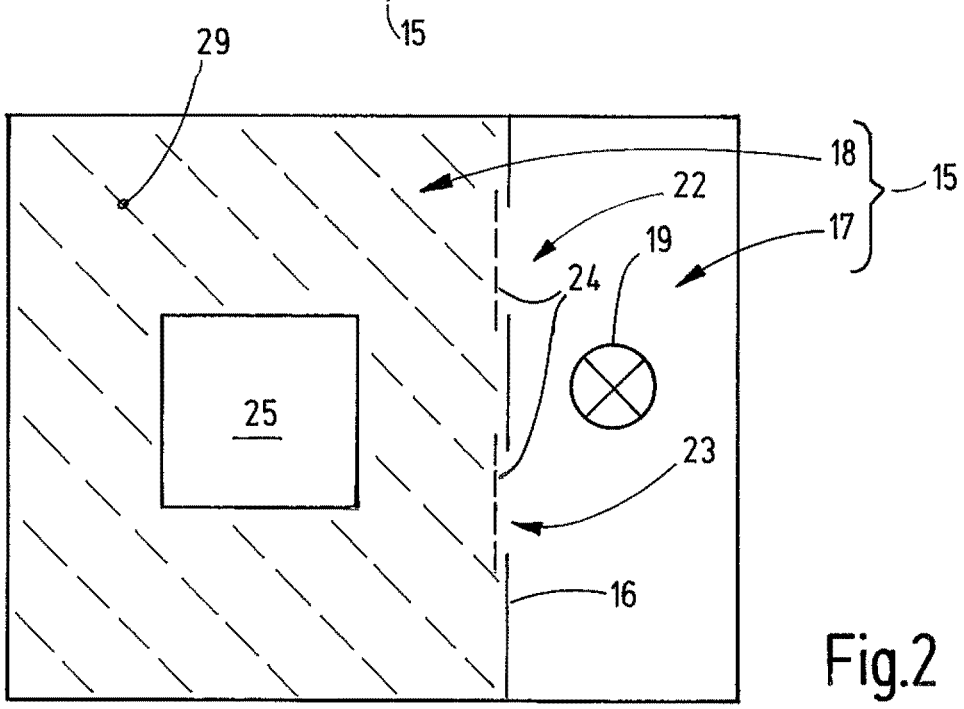

A light source 19 is arranged in the section 17 of the inner space (FIG. 2), for example in form of one or more LED-chips 20 that can be supported by the separating wall 16. The LED-chip(s) 20 can be arranged at the separating wall 16 directly or by an intermediate carrier, wherein the separating wall 16 is preferably held between the two enclosure parts 11, 12. For this purpose at least one of the two enclosure parts 11, 12 comprises a seat 21 for receipt of the circumferential edge of the separating wall 16, such that the separating wall 16 traverses the inner space 15 along the complete cross-section. The separating wall 16 can be made of metal or as it is preferred of an electrically insulating material. In the latter case it can support conductor tracks for an electric supply of the LED-chips 20. As necessary, further electric components can be arranged on the separating wall 16 that is configured as circuit board.

The separating wall 16 comprises at least one, preferably a plurality of openings 22, 23 via which the two sections 17, 18 of the inner space 15 are in connection with each other. The openings 22, 23 are preferably grouped around the at least one LED-chip in order to allow a fast pressure compensation between the two sections 17, 18 of the inner space 15.

At the at least one opening 22, in the present embodiment at both openings 22, 23, a filter 24 can be arranged that can consist of a fine-poured material. This filter 24 can be made by arranging a textile non-woven fabric, a woven fabric, a knitted fabric, a non-woven fabric of mineral material, like glass wool, rock wool or the like, a rigid porous plate or a plurality of rigid porous elements, a strainer formed of wires or threads, like for example a plastic strainer, a wire strainer, a perforated plate, a grid or the like. The mesh or opening width of this filter 24 is preferably so small that particles arranged in the second section 18 of the inner space 15 cannot pass through the openings 22, 23. If instead of a pourable particulate material, a batting-like material is provided, the filter 24 can be avoided.

The second section 18 of the inner space 15 serves for accommodation of an electric or an electronic circuit 25 that can serve as operating device for the light source 19, for example, and can for example comprise electronic components 27, 28 arranged on a circuit board 26.

The second section 18 is preferably filled with a pourable fill material 29, like for example glass spheres, sand or the like. The particles of this pourable material are larger than the mesh width of the filter 24. If the openings 22, 23 are smaller than the size of the particles of the pourable material, the filter 24 can be avoided. Similarly the filter 24 can be avoided, if the section 18 of the inner space 15 is filled with a different open pored material, like for example glass wool, rock wool or the like, instead of pourable material. The second section 18 of the inner space 15 can be completely or partly filled with such an open pored material for this purpose.

During operation of the explosion-protected luminaire 10 an explosive gas mixture may have entered the inner space 15. Present ignition sources can be particularly the light source 19, for example the LED-chip(s) 20 or also the electronic components 27, 28. An ignition of the gas mixture in the section 18 is, however, avoided due to the filling of this section 18 with the fill material 29. If, however, an ignition happens in the section 17, the forming blast wave can enter through the openings 22, 23 into the section 18 of the inner space 15 and expand therein. In doing so, the blast wave passes into the fill material 29 that inhibits the propagation of the explosion or at least mitigates the blast wave by absorption. Thus, the section 18 of the inner space 15 acts as expansion space for an explosion that took place in the section 17. Thus, the enclosure parts 11, 12 can be configured relatively thin-walled without bursting risk. The free explosion volume in the enclosure 10 is remarkably reduced. Similarly created pressure peaks are highly reduced.

As shown in FIG. 1, the enclosure 10 is preferably configured in a closed manner. Alternatively a pressure relief opening can be provided at the enclosure part 11 and/or the enclosure part 12 that leads to the outside and that is provided with a porous gas permeable flameproof filter as pressure relief body. This is, however, unnecessary in most cases.

Figure 3:
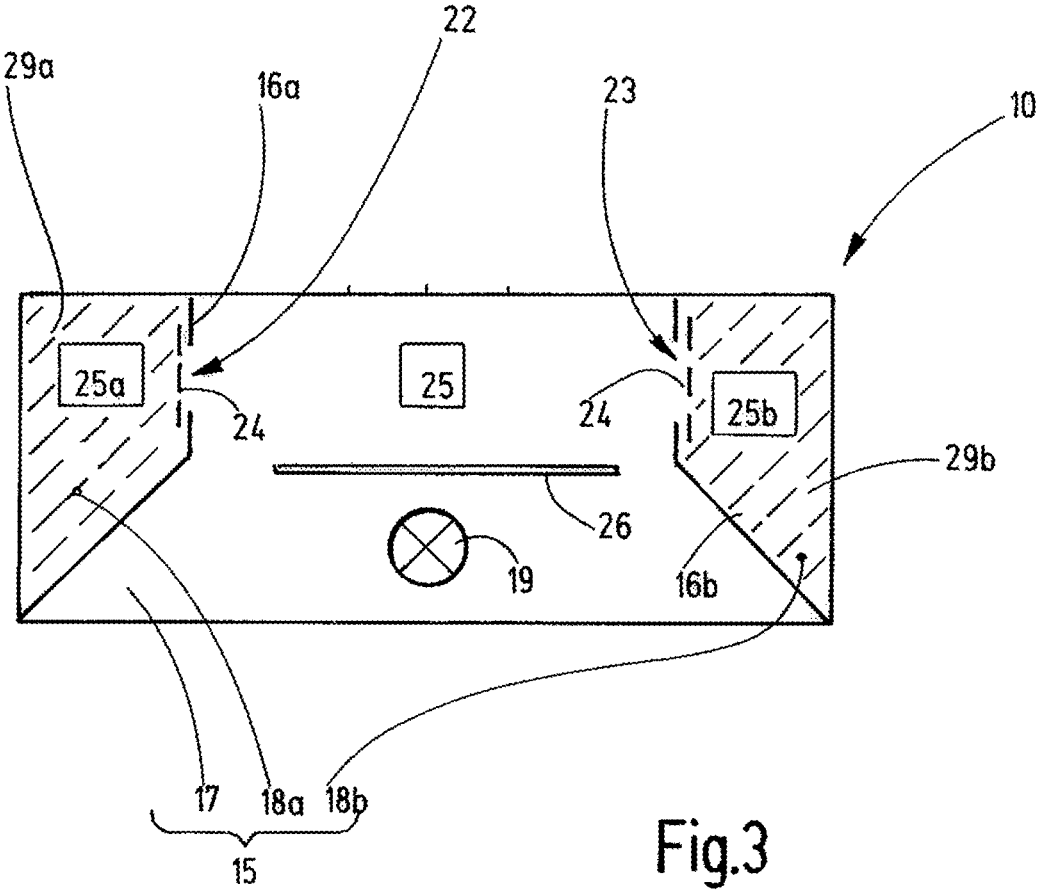

FIG. 3 illustrates a modified embodiment of the luminaire 10 that comprises two separating walls 16*a*, 16*b* that subdivide two sections 18*a*, 18*b* from the inner space 15 that are provided with porous damping fill material 29*a*, 29*b*. The circuit board 26 can support the light source 19 and/or the operating circuit 25 that can be arranged in the first section 17. Alternatively the operating circuit 25' can be arranged in one of the sections 18*a*, 18*b*. Alternatively the operating circuit can be split in two circuits 25*a*, 25*b* and placed in the two sections 18*a*, 18*b*. In a further alternative the circuit 25 can be placed as part of the operating circuit in the section 17 and additionally as another circuit 25*a*, 25*b* as circuit portion 25*a*, 25*b* in the sections 18*a* and/or 18*b*.

The luminaire 10 according to the invention comprises an inner space 15 that is separated into a first section 17 and a second section 18 by a separating wall 16, while the first section 17 is free and comprises at least one light source, an operating circuit 25 for the light source 19 and/or other components that form potential ignition sources and/or other components that may not be considered as ignition sources are arranged in the second section 18. The second section 18 is provided with an open pored fill material. The separating wall 16 comprises at least one opening 22 that allows a flow connection between the two sections 17, 18. The section 18 of the inner space 15 provided with fill material 29 serves as pressure relief volume for the first section 17, in which the light source is arranged. The fill material 29 can fill the section 18 completely or partly.

LIST OF REFERENCE SIGNS

10 luminaire
11, 12 enclosure parts
12*a* transparent zone or transparent part of the enclosure
13 separating joint
14 seal
15 inner space
16, 16*a*, 16*b* separating wall
17 first section of the inner space 15
18, 18*a*, 18*b* second section of the inner space 15
19 light source
20 LED-chip(s)
21 seat
22, 23 openings in the separating wall 16
24 filter
25, 25' circuit/operating circuit
26 circuit board
27, 28 electronic components
29, 29*a*, 29*b* fill material

The invention claimed is:

1. An explosion-protected luminaire, comprising:
an enclosure having a translucent section that surrounds an inner space;
at least one separating wall having at least one opening, the at least one separating wall dividing the inner space of the enclosure into at least one first section without fill material and at least one second section with fill material;
the first section without fill material comprises a light source and the first section is translucent in a region proximate to the light source;
the second section is located behind the at least one separating wall, and the fill material is an open pored material;
an electronic circuit is arranged in the second section of the inner space; and
wherein the fill material fills the second section of the inner space of the enclosure completely such that blast waves from the first section are absorbed by the fill material in the second section.

2. The luminaire according to claim 1, wherein the enclosure comprises a first enclosure part and a second enclosure part that, the first enclosure part and the second enclosure part comprising a translucent material and wherein the at least one separating wall is retained between the first enclosure part and the second enclosure part.

3. The luminaire according to claim 1, wherein the enclosure is a profile part, into which the fill material is slid in.

4. The luminaire according to claim 1, wherein the at least one separating wall is held at its complete circumference in the enclosure.

5. The luminaire according to claim 1, wherein the at least one separating wall is integrated into the enclosure.

6. The luminaire according to claim 1, wherein a filter is arranged at the at least one opening.

7. The luminaire according to claim 6, wherein the filter is an open pored body selected from one of the following; a textile material, a filter, a wire mesh network, and a porous body.

8. The luminaire according to claim 1, wherein the fill material is a pourable fill material.

9. The luminaire according to claim 1, wherein the separating wall carries the light source.

10. The luminaire according to claim 1, wherein the separating wall is a circuit board.

11. The luminaire according to claim 1, wherein an electronic circuit is arranged in the first section of the inner space.

12. The luminaire according to claim 2, wherein the enclosure is a profile part, into which the fill material is slid in.

13. The luminaire according to claim 12, wherein the at least one separating wall is held at its complete circumference in the enclosure.

14. The luminaire according to claim 13, wherein the at least one separating wall is integrated into the enclosure.

15. The luminaire according to claim 14, wherein a filter is arranged at the at least one opening.

16. The luminaire according to claim 15, wherein the filter is an open pored body selected from one of the following; a textile material, a filter, a wire mesh network, and a porous body.

17. The luminaire according to claim 16, wherein the fill material is a pourable fill material.

* * * * *